US008653962B2

(12) United States Patent
Maeng

(10) Patent No.: US 8,653,962 B2
(45) **Date of Patent: *Feb. 18, 2014**

(54) WIRELESS EVENT STATUS COMMUNICATION SYSTEM, DEVICE AND METHOD

(75) Inventor: Joon Maeng, Austin, TX (US)

(73) Assignee: Strauss Acquisitions, L.L.C., Wilmington, DE (US)

( * ) Notice: Subject to any disclaimer, the term of this patent is extended or adjusted under 35 U.S.C. 154(b) by 604 days.

This patent is subject to a terminal disclaimer.

(21) Appl. No.: 12/395,864

(22) Filed: Mar. 2, 2009

(65) Prior Publication Data

US 2009/0160637 A1 Jun. 25, 2009

Related U.S. Application Data

(63) Continuation of application No. 11/394,443, filed on Mar. 31, 2006, now Pat. No. 7,498,936.

(60) Provisional application No. 60/667,259, filed on Apr. 1, 2005, provisional application No. 60/714,786, filed on Sep. 7, 2005.

(51) Int. Cl.
*G08B 1/08* (2006.01)

(52) U.S. Cl.
USPC ..... 340/539.1; 340/539.26; 340/5.71; 340/540; 340/10.3

(58) Field of Classification Search
USPC ..... 340/539.1, 539.26, 5.71, 540, 10.2, 340/10.3, 10.5, 529, 539.22, 679, 686.1; 345/173
See application file for complete search history.

(56) References Cited

U.S. PATENT DOCUMENTS

| | | | | |
|---|---|---|---|---|
| 6,166,634 | A | 12/2000 | Dean | |
| 6,401,466 | B1 | 6/2002 | Olsen | |
| 6,593,856 | B1 | 7/2003 | Madau | |
| 6,597,291 | B2 | 7/2003 | Tsui | |
| 6,766,162 | B1 * | 7/2004 | Beamish | 455/412.1 |
| 6,989,760 | B2 | 1/2006 | Dierking et al. | |
| 7,196,623 | B1 | 3/2007 | Wang | |
| 7,332,999 | B2 * | 2/2008 | Fitzgibbon | 340/5.71 |
| 7,498,936 | B2 * | 3/2009 | Maeng | 340/539.1 |
| 7,532,709 | B2 * | 5/2009 | Styers et al. | 379/37 |

* cited by examiner

*Primary Examiner* — Anh V La

(57) ABSTRACT

A wireless event status communication system, device and method are disclosed. In one form, a wireless enabled notification system includes a wireless informer operably associated with an environmental element having more than one operating state and operable to determine a current operating state of the environmental element and to communicate the current operating state via a wireless communication module. The system further includes a remote status notification device operable to receive the communication including the current operating state. The remote status notification device including a processor operable to determine a last current operating state when the remote status notification device is out of range of the wireless informer.

35 Claims, 12 Drawing Sheets

WIRELESS EVENT STATUS COMMUNICATION SYSTEM, DEVICE AND METHOD

CROSS REFERENCE TO RELATED APPLICATIONS

This application is a continuation application of U.S. patent application Ser. No. 11/394,443, filed Mar. 31, 2006, now U.S. Pat. No. 7,498,936, issued Mar. 3, 2009, which claims priority to U.S. Provisional Application entitled "Method and System for Reminding Event on Separation" having application Ser. No. 60/667,259 and filed on Apr. 1, 2005 and U.S. Provisional Patent Application entitled "Method and System for Producing a Warning When Leaving Home Without Closing Garage Door" having application Ser. No. 60/714,786 and filed on Sep. 7, 2005 herein incorporated by reference.

FIELD OF THE DISCLOSURE

The present invention generally relates to notification systems, and more particularly, to a wireless event status communication system, device, and method.

BACKGROUND

Individuals have used a variety of systems to assist themselves with remembering items. For example, one classic technique still being used today is to tie a ribbon to a finger to help an individual remember an item. Though very effective for remember a single item, using multiple ribbons to remember multiple items is not practical. Another simple, but effective, technique is to make a list of items to remember. However, some individuals may misplace the list leaving the individual with having to attempt to remember each item that was on the list. Several conventional electronic devices are currently being offered to manage remembering items. For example, some individuals create and update 'too-do' lists using handheld devices or personal digital assistants (PDAs) that may be updated and reviewed on a regular basis. However, these types of reminder devices can be difficult to maintain when life situations become too hectic. Moreover, such handheld devices lack the ability to obtain inputs from external sources other than a user inputting items. Additionally, PDAs further lack the ability to automatically update or notify users of current operating states or conditions of various environmental elements external to a PDA. For example, an individual may forget to perform various tasks prior to leaving a premises. Currently, PDAs and other electronic devices do not allow for 'real time' updates as to the current operating state of one or more environmental element associated with a residence. As such, what is needed is a method and system for actively determining a current operating state of one or more environmental element of a premises and notifying a user of an adverse operating state as an individual travels away from the premises.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 13 illustrates a timing diagram for outputting signals using a sensor for an automatic garage door system employing a wireless notification system according to one aspect of the invention;

SUMMARY OF THE INVENTION

A wireless event status communication system, device and method are disclosed. In one form, a wireless enabled notification system includes a wireless informer operably associated with an environmental element having more than one operating state and operable to determine a current operating state of the environmental element and to communicate the current operating state via a wireless communication module. The system further includes a remote status notification device operable to receive the communication including the current operating state. The remote status notification device including a processor operable to determine a last current operating state when the remote status notification device is out of range of the wireless informer.

According to another aspect of the invention, a method for communicating an operating state of a multiple state operating device is disclosed. The method includes determining an operating state of a multiple state environmental element and associating the operating state with an identifier operably associated with a remote status notification device and an informer. The method further includes communicating the identifier and the current operating state to the remote status notification device and receiving the communication using the remote status notification device. The method also includes detecting when the remote status notification device is out of range of the informer and determining the last operating state received by the remote status notification device.

A wireless enabled communication status notification system is provided. The system includes an automatic garage door opener system including a sensor operable to provide a current operating state, the automatic garage door opener system including an informer operable to communicate the current operating state. The system further includes a remote control device operable to receive a series of communication signals communicated by the automatic garage door opener system. The signals received include references to the current operating state of the automatic garage door opener system. The remote control device further includes a processor operable to determine a last operating state when the remote control device is out of range of the informer.

DETAILED DESCRIPTION

Figure 1:
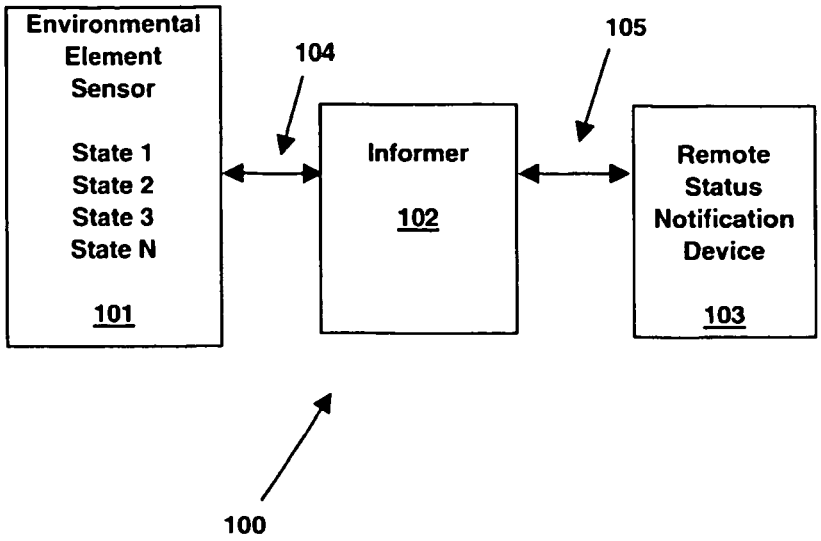
FIG. 1 illustrates a block diagram of a wireless enabled notification system according to one aspect of the present invention.

FIG. 1 illustrates a block diagram of a wireless enabled notification system according to one aspect of the present invention. A notification system, illustrated generally at 100, includes an environment element sensor 101 operable to detect one or more operating states and communicate a current operating state to an informer 102. Notification system 100 further includes a remote status notification device 103 communicatively coupled to informer 102. Environment element sensor 101 and informer 102 may be provided as the same unit or as separate units. For example, informer 102 may be coupled to environment element sensor 101 via first communication medium 104 which may be a hardwired or electrical communication medium or via a wireless-enabled communication medium.

Notification system 100 further includes a remote status notification device 103 wirelessly coupled to informer 102 via a wireless communication medium 105 such as a short-range or long-range wireless enabled communication networks or mediums including AM, FM, VHF, UHF, Microwave, 802.x, Bluetooth, WIFI enabled networks, a wireless home RF network, a cellular telephone network, a satellite network, a laser communication medium, an infrared communication medium, or any other type of communication medium.

During operation of notification system 100, environmental element sensor 101 monitors an operating state of a system or device. For example environment element sensor 101 may be coupled to an automatic garage door system, one or more locks for securing a premises or building, an electric or gas stove, an electric iron, a water system, an electric or gas oven, a electric toaster oven or other various other appliances or electronic devices that may be left in an undesirable or adverse operating state. For example, a user leaving a premises would not desire to leave an electric iron on, water running, an air conditioner running, a garage door open, a stove on, or other undesirable operating states for a system, device, or appliance that may be left in an undesired operating state which may present a hazard or other undesired condition. As such, environmental sensor 101 may various types of sensors operable to detect various different operating states including, but not limited to, a heat sensor, a motion sensor, an ultrasonic sensor, an electronic switch, a current sensor, a temperature sensor, a flow sensor including gas and liquids, a vibration or shock sensor, and various other types of sensors that may be used as an environmental element sensor to sense an operating condition.

Environmental element sensor 101 senses a current operating state and communicates the current operating state to informer 102 and informer 102 is operably associated with environmental element sensor 101 to determine one or more operating states sensed by environmental sensor 101. Informer 102 communicates a current operating state to remote status notification device 103 via wireless communication medium 105 and remote status notification device 103 receives the communication including the current operating state and processes the communication to determine the current operating state of environment element sensor 101. Informer 102 provides a periodic notification of an current operating state to remote status notification device 103 and remote status notification device 103 continues to receive communications from informer 102 and update remote status notification device 103 to store a current operating state provided by informer 102 as a last operating state. Upon remote status notification device 103 being displaced out of a wireless operating range of informer 102 (i.e. out of range), remote status notification device 103 determines the last operating status and determines if an adverse operating state or condition is provided as the last operating state. If an adverse operating condition exists, remote status notification device 103 alerts a user of an adverse condition for environmental sensor 101. However, if the last operating state is not an adverse condition, remote status notification device 103 would not alert a user or indicate that the last operating state is not adverse. In this manner, as user travels away from a location, such as a premises, home, office, etc., a user may be informed of adverse or undesired operating condition remotely.

In one embodiment, remote status notification device 103 may query or request status or state information from informer 102. For example, remote status notification device 103 may include a motion sensing device or vibration sensing device (not expressly shown) that may sense when a user is traveling away from informer 102. For example, remote status notification device 103 may include a vibration mechanism that senses movement and may poll or query informer 102 to determine an operating state of environmental element sensor 101. Informer 102 may determine the current operating state of environmental element sensor 101 by accessing or sensing an input from medium 104. However, in another embodiment, informer 102 may include a current operating state within a memory or buffer of informer 102 (not expressly shown) and provide the current state to remote status notification device accordingly.

In another embodiment, remote status notification device 103 may monitor a signal strength of a signal provided via wireless communication medium 105 and as a signal weakens, remote status notification device 103 may poll or request a current operating state from informer 102. For example, informer 102 may receive the poll or query and wirelessly communicate the current operating state of environmental element sensor 101 to remote status notification device 103. As such, remote status notification device 103 may request an operating state and notify a user if an adverse operating state for an environmental element exists.

Figure 2A:
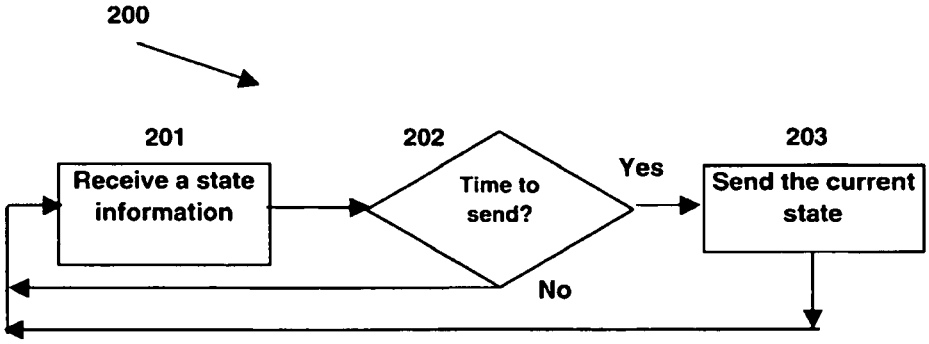
FIG. 2A illustrates a flow diagram of a method for providing an operating state for an environmental element according to one aspect of the invention.

FIG. 2A illustrates a flow diagram of a method for providing an operating state for an environmental element according to one aspect of the invention. FIG. 2A may be employed by system 100 provided in FIG. 1 or any other system operable to employ the method of FIG. 2A. At step 201, an operating state is received from an environmental sensor operable to determine an operating state. The method then determines if a current operating state should be communicated at step 202. For example, a current operating condition may be communicated on a periodic basis at a pre-determined interval (e.g., 1/10 second). If a current operating state is to be communicated, the method proceeds to step 203 and the current operating state is communicated. For example, a current operating state may be formatted by an informer to be communicated via a wireless communication network and transmitted to a remote notification device. As such, method 200 may be used to receive state or status information from an environmental element sensor and periodically wirelessly communicate state information to a remote status notification device.

Figure 2B:
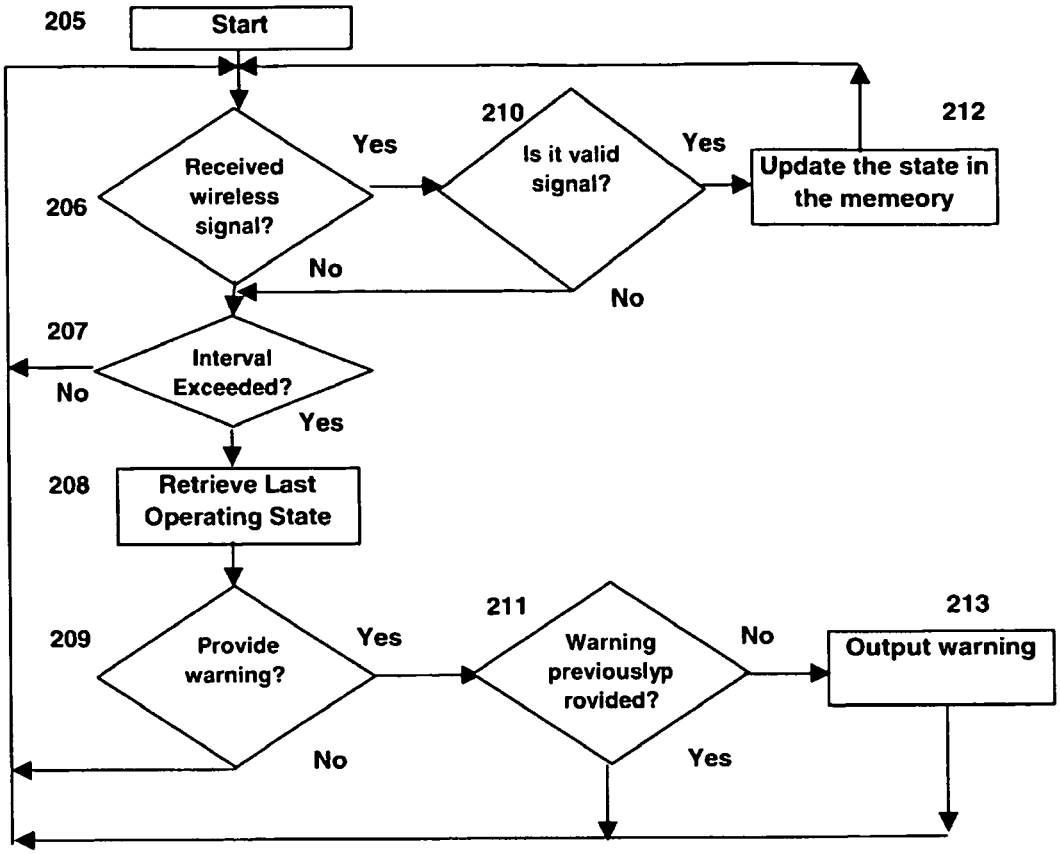
FIG. 2B illustrates a flow diagram of a method for processing an operating state using a remote status notification device according to one aspect of the invention.

FIG. 2B illustrates a flow diagram of a method for processing an operating state using a remote status notification device according to one aspect of the invention. FIG. 2A may be employed by system 100 provided in FIG. 1 or any other system operable to employ the method of FIG. 2A. The method begins generally at step 205. If a wireless signal is received 206, the wireless signal is processed to determine if the wireless signal is valid 210. If the signal is not valid, the method proceeds to step 207. If a valid wireless signal is received, a memory device associated with a remote status notification device is updated to store a current operating state communicated by an informer as a last operating state. A reference or counter is also updated to indicate that a valid signal has been received. The method proceeds to step 206 to determine if another wireless signal is received.

If at step 210, a signal is not valid, the method proceeds to step 207 to determine if an interval for receiving valid signals has been exceeded. For example, if the signal strength of a signal is too weak or if a wireless signal has not been received, the method proceeds to step 207 to determine if a time interval for receiving a valid signal has been exceeded. For example, if an interval of five valid signals has been established as an interval and more than five valid signals have been received, the interval would not be exceeded and the method would proceed to step 206 to receive another signal. If more than five invalid signals have been received or an interval has been time interval for receiving a single valid signal has been exceeded, the method proceeds to step 208. Other techniques may also be employed to determine if a remote status notification device is out of range of an informer. In one embodiment, a "time out" may include exceeding a pre-determined transmission interval for receiving a valid signal.

At step 207, when a signal has not been received or if a time period for a valid signal is exceeded, the last operating state stored in memory is retrieved 208 and processed to determine if a warning should be produced 209. For example, the state information may include a flag or bit set to a value that may be verified to determine if an adverse operating condition exists. If an adverse condition exists, the method proceeds to step 211 to determine if a warning was previously provided. If a warning was not previously presented, the method proceeds to step 213 and provides an output warning 213 to alert a user of an adverse operating condition. If a warning had been previously presented to a user, the method proceeds to step 206 to monitor for a wireless signal. In this manner, when a remote device notification device moves in and out of range of a valid wireless network, status information may be received and an output warning may be provided to a user accordingly.

In one embodiment, step 212 may be modified to update the state in memory only when an adverse operating condition is determined or to set one or more flags or bits to identify that an adverse operating condition presently exists. For example, if an adverse operating condition is received, a flag may be set identifying that an adverse operating condition exists. As such, the flag would be checked to determine if an adverse condition exists and proceed accordingly. Similarly, if an adverse operating condition is determined, and a current state is communicated, the flag identifying the adverse operating condition may be set and reset as needed. In this manner, various embodiments for determining and managing operating states of an environmental element may be employed to determine if an adverse or undesired operating condition exists.

In one embodiment, step 212 may be modified to receive a minimum number of valid signals prior to updating memory. For example, the method may be modified such that at least three valid signals are received from an informer prior to updating the memory with a current state.

Figure 3:
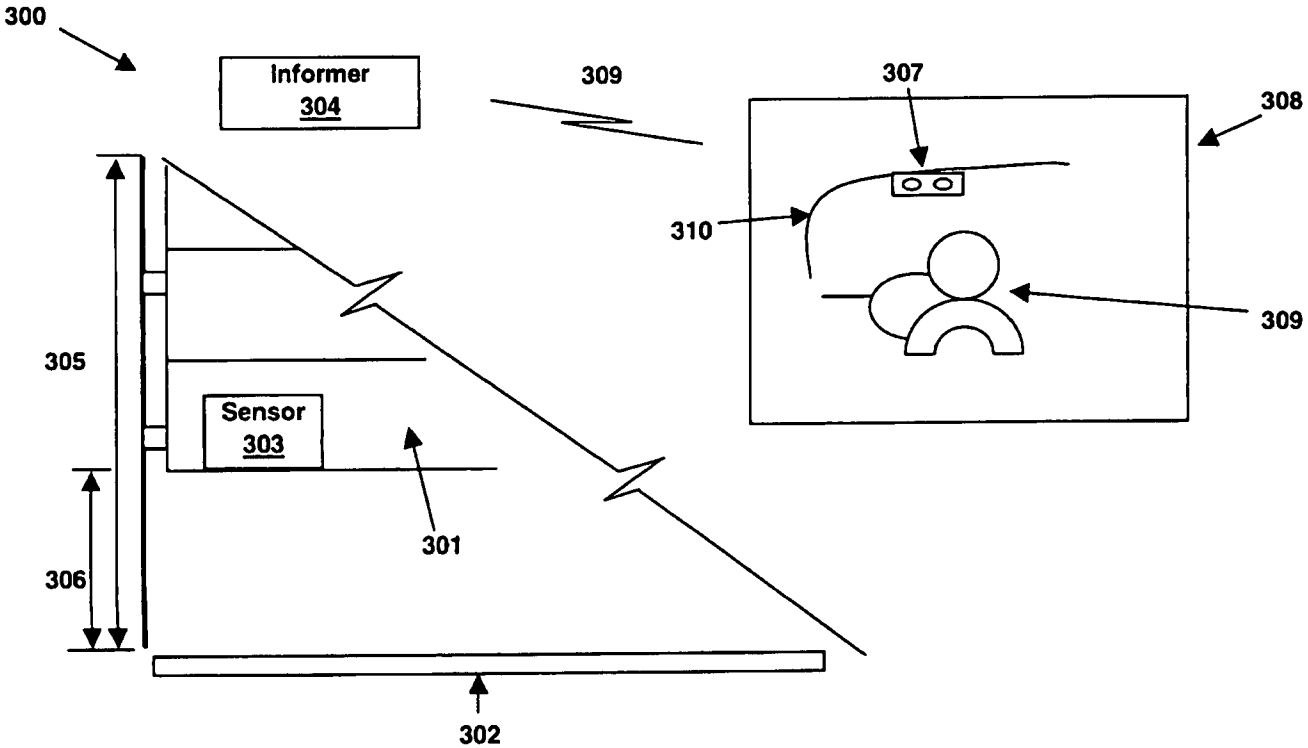
FIG. 3 illustrates a wireless enabled notification system employed in association with a garage door and automobile according to one aspect of the invention.

FIG. 3 illustrates a wireless enabled notification system employed in association with a garage door and automobile according to one aspect of the invention. A wireless enabled notification system, illustrated generally as notification system 300, includes a sensor 303 coupled to a garage door 301 and operable to sense an operating state of garage door 301. For example, sensor 303 may sense when garage door 301 is in an open state having first height 305, a partially open state having second height 306, and a closed state when sensor 303 is proximal to floor 302. Sensor 303 may include various types of sensors operable to sense a position of garage door 301 including an ultrasonic sensor, a laser sensor, or an infrared sensor.

Notification system 300 further includes an informer 304 coupled to sensor 303 and operable to communicate an operating state sensed by sensor 303. Sensor 303 may be provided as a separate unit from informer 304 however in other embodiments, informer 304 and sensor 303 may be provided as the same module or device. Sensor 303 provides informer 304 a an input representing a current operating state using a wireless or wireline communication medium to informer 304. An input may include an analog signal or voltage level representing the current operating state and informer 304 converts the input to a digital representation of the current operating state. A reference to the current operating state is provided based on the converted analog signal or voltage level. For example, sensor 303 may provide various voltage levels and in one embodiment may provide a voltage level ranging between one (1) and five (5) volts. For example, an input of less than one (1) volt may be provided when a garage door is closed, a input between one (1) and two (2) volts may be provided when a garage door is opening, an input between two (2) and three (3) volts may be provided when a garage door is closing and input of five (5) volts may be provided when a garage door is open. Various other combinations of voltage levels or signals may also be used.

Upon informer 304 obtaining an input from sensor 303 and informer 304 determining an operating state based on the input, informer 304 formats a message including a reference to the operating state and communicates the message to remote status notification device 307 via wireless communication medium 309.

As illustrated, informer 304 is provided as a separate unit from sensor 303 and may be coupled to sensor 303 via wireless communication or may be coupled using a wireline connection. However in other embodiments, informer 304 and sensor 303 may be provided as a single or separate units and informer 304 and/or sensor 303 may also be located along various portions of a garage wall or integrated as a part of an automatic garage door system (not expressly shown).

During operation, sensor 303 senses four different operating states of garage door 301 including:

1) Door is open;
2) Door is closed;
3) Door is opening; and
4) Door is closing.

When sensor 303 senses one the operating states of garage door 301, sensor 303 communicates the new operating state as a current operating state to informer 304 and informer 304 formats the current operating state to provide a message or data packet that includes a unique identification number or device ID for informer 304 and the current operating state sensed by sensor 303. Informer 304 wirelessly communicates the data packet or message via wireless communication medium 309 to a remote status notification device 307. Remote status notification device 307 may be coupled to an interior 310 of an automobile 308. A driver 309 of automobile 308 may then view a current status indicator provided by remote status notification device 307.

In another embodiment, informer 304 periodically communicates a current status message and remote status notification device 307 receives the current status message and stores the current status or state information within memory of remote status notification device 307. As driver 309 drives automobile 308 away from garage door 301 (i.e. driver is leaving home), informer 304 continues to communicate a current status message. When remote status notification device 307 and vehicle 308 are out of communication range (e.g., 150 feet) of informer 304, remote status notification device 307 determines the last current status message stored within memory and determines if an undesired operating state of garage door 301 is the last stored state. If an adverse state has been determined, remote status notification device 307 alerts driver 309 using a display or audio sound provided in association with remote status notification device 307 allowing driver 309 to return and alter the last state such as closing garage door 301.

In another embodiment, remote status notification device 307 may indicate status information for both an adverse and favorable operating conditions. For example, when a status message is received by remote status notification device 307, remote notification status device 307 stores the status information within memory of remote notification status device 307. If an adverse condition exists such as a garage door being open, a status indicator, such as a red illuminator or lamp, may be illuminated to indicate that an adverse condition such as garage door 301 was left in an open state. If garage door 301 was left in a closed position (i.e. a user closed the door or an automatic door system closed the door), remote notification status device 307 receives a message from informer 304 that garage door 301 is in a closed state and remote status notification device may illuminate a status light, such as a green illuminator or lamp, to indicate that a valid or desired state is the last operating state. In this manner, adverse and favorable operating states may be presented to driver 304.

In one embodiment, informer 304 may be provided in association with an automatic garage door system (not expressly shown) operable to automatically open and close garage door 301. For example, informer 304 may be attached to a portion of garage door 301 or along a portion of a frame or mount (not expressly shown) for garage door 301 and communicate status information to remote status notification device 307 based on an operating condition of an automatic garage door system coupled to garage door 301. In this manner, notification system 300 may be employed independent of an automatic garage door system and monitor an operating condition of an automatic garage door system by detecting an operating state of garage door 301 that is controlled by a separate automatic garage door system.

In one embodiment, informer 304 may detect a status of garage door 301 and transmit or communicate the status to remote status notification device 307 using a unique identification or identifier. For example, informer 304 may provide a unique identification number in association with the status information. Remote status notification device 307 may determine the identification number of a received message prior to determining the operating status of garage door 301. In this manner, if multiple informers are being used, remote status notification device 307 may be pre-programmed to uniquely identify signals communicated by informer 304 and if more than one informer is communicating status information, remote status notification device 307 may detect only valid signals and store status information for only informer 304 accordingly. As such, a single frequency or range of frequencies may be used to communicate status messages having unique identification numbers for informers provided as unique identifiers and used to determine status information for a valid communication between an informer and remote status notification device obviating the need for various specific frequencies to be programmed or reprogrammed for each informer/remote status notification device(s) pair being used.

In another embodiment, remote status notification device 307 may not actively present a current status and, when remote notification status device 307 is out communication range of informer 304, remote status notification device 307 may retrieve status information stored within memory of remote notification status device 307 from memory. For example, if garage door 301 was left in an open position, as automobile 308 moves out of range of informer 304, an alert may be provided via remote status notification device 307 allowing a user to return and close garage door 301 if desired.

In another embodiment, remote status notification device 307 may query or poll informer 304 to provide a current status of garage door 301. For example, when driver 309 starts vehicle 308 and begins to pull out of a garage or away from a residence, remote status notification device 307 may detect vehicle 308 is moving and query informer 304 as to the current status of garage door 301. For example, remote status notification device 307 may be coupled to a power system of vehicle 308 and remote status notification device 307 may turn on when vehicle 308 is turned on. In another embodiment, remote status notification device 307 may turn on when a motion sensing circuit (not expressly shown) provided in association with remote status notification device 307 is detected. Such motion sensing circuits may include infrared sensing, ultrasound sensing, vibration sensing or various other motion sensing circuits.

Figure 4:
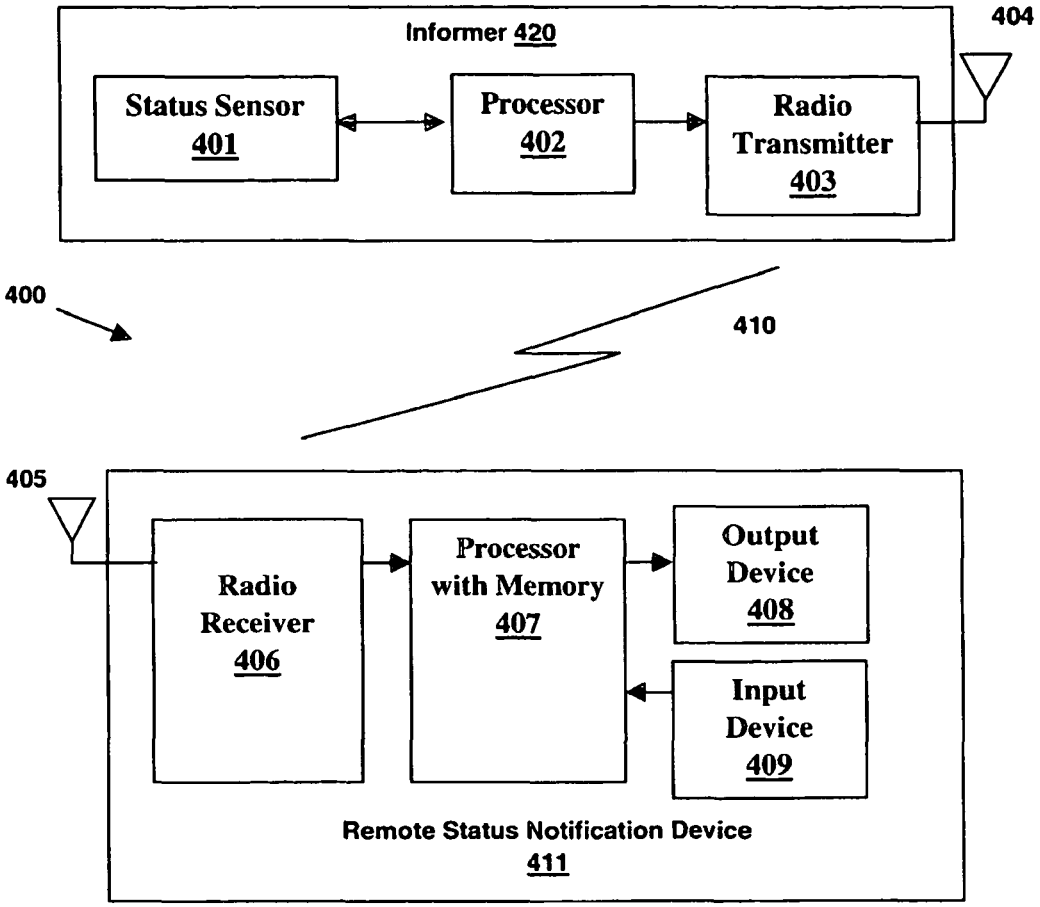
FIG. 4 illustrates a functional block diagram of a wireless enabled notification system employing a remote status notification device having a processor with memory operable to store a current state according to one aspect of the invention.

FIG. 4 illustrates a functional block diagram of a wireless enabled notification system employing a remote status notification device having a processor with memory operable to store a current state according to one aspect of the invention. A wireless enabled notification system, illustrated generally as notification system 400, includes an informer 420 including a status sensor 401 such as ultrasonic sensor module 900 illustrated in FIG. 9 as described below. In other embodiments, status sensor 401 may include an infrared sensor, laser beam sensor, or other light sensing measurement devices. In one embodiment, a different technology such as accelerometer or airflow direction sensor may be used in determining the direction of door movement of a garage door or other environmental element. Informer 420 further includes a processor 402, and a radio transmitter 403 operable to send a receive wireless signals such as RF signals using antenna 404 and wireless communication medium 410. Notification system 400 further includes a remote status notification device 411 having a radio receiver 406 coupled to antenna 405 and operable to receive signals via communication medium 410. For example, radio transmitter 403 may be operable to communicate a status message or data packet using various types of RF communications including, but not limited to AM, FM, VHF, UHF, Microwave, 802.11, Bluetooth, or any other transmission mediums.

Remote status notification device 411 further includes a processor with memory 407, an input device 409 such as an acknowledge button, an output device 408 such as an indicator and/or speaker. Informer 420 and/or remote status notification device 411 may include replaceable or rechargeable batteries (not expressly shown) and an associated power distribution circuits for distributing power as needed (not expressly shown). In one form, informer 420 and/or remote status notification device 411 may include a power saving or sleep modes for conserving energy when not in use.

During operation, processor 402 determines the current status of a garage door by polling status sensor 401. Status sensor 401 may be an ultrasonic sensor operable to measure a distance a garage door is from a garage floor or ground. In one embodiment, processor 402 measures a distance at fixed time intervals by polling status sensor 401 and determining a current status of a garage door using status information. Based on a current operating state provided by status sensor 401, processor 402 may determine if a garage door is open, opening, closed, or closing. Processor 402 may also determine if a garage door is only open or opening as needed. Processor 402 formats a status message including an identification that identifies informer 420 and a current status provided by status sensor 401. For example, a status provided may include a code for "door open", "door opening", "door closed" or "door closing".

In one embodiment, status sensor 401 may be used to sense an operating status of a garage door at a fixed time interval (e.g., every second). In another embodiment, status sensor 401 may include a movement or motion detector (not expressly shown) to detect a status when motion is sensed. For instance, if a garage door has not moved over a period of time, status sensor 401 may not check the status of a garage door or may only check the status of the garage door at a longer sample interval (e.g., 10 seconds). When a motion detector provided in association with status sensor 401 detects a door is moving or movement is detected using a longer sample interval (e.g. 10 seconds), status sensor 401 senses the current status immediately and continues to monitor the status until the garage door stops moving. In this manner, status sensor 401 need not sample a status of a garage door unless movement is detected thereby reducing power consumption of status sensor 401 during inactive periods.

Upon status sensor 401 providing a status to processor 402 and processor formatting a status message, radio transceiver 403 transmits the encoded status message using wireless communication medium 410 such as an RF communication medium. Radio receiver 406 receives the signal and status message communicated by informer 420 and provides a decoded signal and status message to processor 407. Processor 407 checks the decoded signal to determine if the decoded signal includes a unique identification number for informer 420 and confirms the format of the data using a predefined data format. Informer 420 and remote status notification device 411 may be programmed to recognize a specific protocol or identification number, device identifier, etc. provided in association with a transmission. For example, informer 420 may communicate a data packet having a specific device identifier as a part of a transmission. Remote status notification device 411 may receive a transmission from informer 420 and determine a valid device identifier and store and/or process the status information as needed. If remote status notification device 411 determines that a transmission is not from informer 420, remote status notification device 411 ignores the transmission.

In one embodiment, a data message may include the format of data message 900 illustrated in FIG. 9 below. If remote status notification device 411 receives a signal that did not originate from informer 420 or has a format that is not valid, processor 407 ignores the information as being invalid. If processor 407 determines that the information is valid, processor 407 stores the valid status information within memory. When remote status notification device 411 no longer receives any additional messages from informer 420 or is out of communication range of informer 420, remote status notification device 411 retrieves the last current status from memory and provides an output using output device 408 if an adverse operating condition is determined as the last stored operating condition.

When informer 420 is provided in association with a garage door and a garage door is left in an open position, processor 407 may store the last operating state within memory. As remote status notification device 411 moves our of range of wireless communication medium 410, processor 407 determines the last operating state and outputs a signal to output device 408 to alert a user if a garage door has been left open. Similarly, if processor 407 determines that a garage door is in the down position, processor 407 may communicate a signal to output device 408 to illuminate a status indicator that indicates that a garage door is in a closed state. Other outputs may also be used including providing an audible output indicating that a garage door is in an open position. Remote status notification device 411 may also include an input device 409 operable to as an acknowledge button for resetting an output provided via output device 408.

In one embodiment, remote status notification device 411 receives a signal at a continuous interval (e.g., every 100 milliseconds) and when remote status notification device 411 moves out of the range of informer 420 radio, receiver 406 no longer receives valid radio signals and processor 407 may detects that a signal has not been received for a predetermined period (e.g., 5 seconds). Processor 407 may then access memory of processor 407 to determine the last operating state communicated by informer 420. Processor 407 may also determine what states are undesirable and if the last state is an undesirable operating condition or state. If an undesired state is determined, processor 407 provides a signal to produce an audible and/or visual warning using output device 408. A user may stop or reset the output by pressing an acknowledge button or input device 409. In one embodiment, output device 408 may produce two separate outputs to indicate an adverse operating state. For example, output device 408 may produce an audio and visual output if an adverse operating state is determined. Input device 409 may be used to reset both outputs. In another form, a desirable operating condition may be determined by processor 407 and a valid output (such as a green light, a ping, etc.) may be output by output device 408 to indicate that a valid operating state was determined.

In one embodiment, notification system 400 may operable as Bluetooth (e.g. 802.11x-based wireless communication) enabled wireless system. For example, Bluetooth is a wireless communication protocol designed for covering communication between various devices in a short range less than ten (10) meters as well as ranges up to one hundred (100) meters. In one embodiment, remote status notification device 411 may be a Bluetooth-enabled cellular phone or mobile device and informer 420 may be operable to communicate an operating status based on a status detected by status sensor 401. For example, status sensor 401 may provide a status of a garage door to informer 411 and radio transmitter 403 may communicate a signal using a BlueTooth communication network to remote status notification device 411 and a current status may be displayed on a display of the cellular phone (not expressly show).

Figure 5:
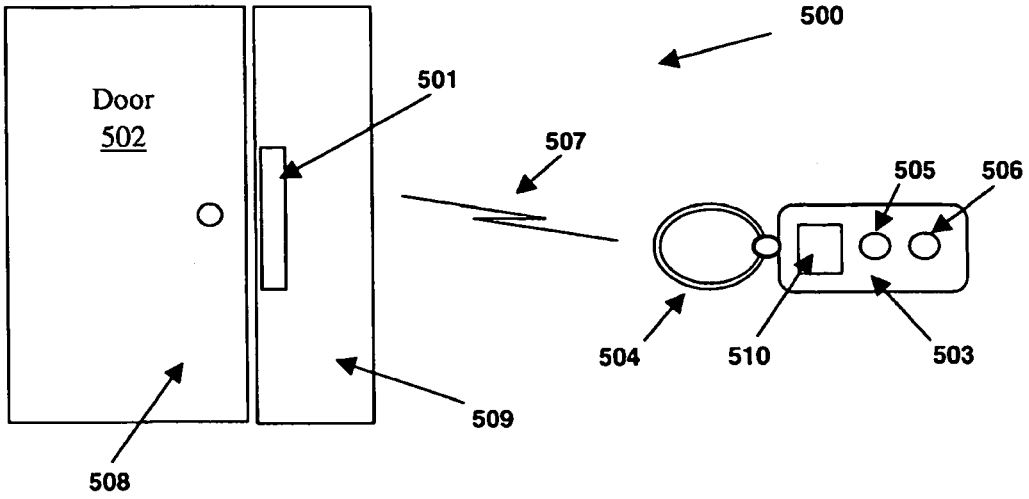
FIG. 5 illustrates a wireless enabled notification system employed in association with a building door lock system according to one aspect of the invention.

FIG. 5 illustrates a wireless enabled notification system employed in association with a building door lock system according to one aspect of the invention. A wireless enabled notification system, illustrated generally at 500, is provided in association with a building having a lockable door 502. Door 502 operably coupled to an informer 501 coupled to doorframe 509 and having a sensor (not expressly shown) operable to detect when a lock or deadbolt is placed in a locked position. System 500 further includes a remote status notification device provided as a keyfob 503 having a first status light 505, a second status light 506, an acknowledge button 510, and a key ring 504 for attaching one or more keys for locking door 502. Informer 501 is operable to communicate a wireless signal to keyfob 503 via a wireless RF communication medium 507.

During use, informer 501 senses or detects if door 502 has been locked and transmits status information to keyfob 503 via wireless communication medium 507. First status light 505 illuminates when power is applied to keyfob 503. When a door is placed in an unlocked or open position, second status light 506 illuminates based on the unlocked or open state to indicate that door 502 is in an unlocked position. For example, if a user leaves a premises without locking door 502, informer 501 detects that door 502 is not locked and transmits a message including the current status information to keyfob 503. When a user is out of communication range for wireless communication network 507, keyfob 503 illuminates second status light 506 indicating that door 502 has been left unlocked. As such, a user may return and lock door 502 and informer 501 may communicate a locked state massage to keyfob 503 and extinguish second status light 506.

In one embodiment, an additional warning may be output by keyfob 503. For example, an audio output or vibration output may be provided to warn a user that an undesired or adverse operating condition for door 502 exists. For example, when keyfob 503 is out of range of informer 501 and an adverse condition exists, a vibrating element within keyfob 503 may be activated to alert a user of an adverse condition. A beeping or audio output signal may also be provided. A user reset the audio output or vibration using acknowledge button 510. A user may then return and lock the door as needed.

In one embodiment, informer 501 may be powered by batteries or informer 501 may be integrated into a building's electrical system. Informer 501 may also be provided as a part of a lock assembly and may also include an independent power source for powering informer 501. In this manner, a user may desire to purchase and install lock assembly employing informer 501 and system 500 to provide a notification as to the status of locking door 501 when a user leaves a premises.

Figure 6:
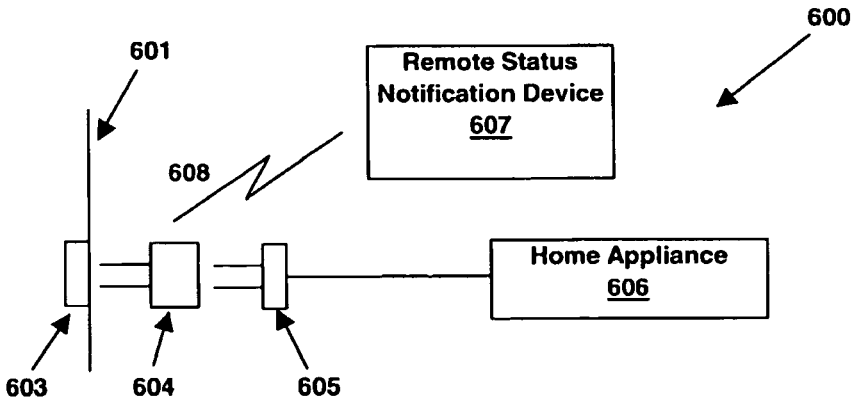
FIG. 6 illustrates a wireless enabled notification system employed in association with a home appliance according to one aspect of the invention.

FIG. 6 illustrates a wireless enabled notification system employed in association with a home appliance according to one aspect of the invention. A wireless enabled notification system, illustrated generally as system 600, includes an informer 604 coupled between a wall socket 603 and an electrical plug 605 of a home appliance or device such as a stove, iron, hotplate, heater, space heater, gas range, or various other types of appliances or home utilities. For example, informer 604 may be used in association with a hot plate or stove to provide a personal remote stove alarm to alert a user when a hot plate or stove is left on presenting a fire hazard.

System 600 further includes a remote device 607 operable to output an alarm when a user leaves home appliance 606 in an undesired operating condition. Home appliance 606 and informer 604 are powered though wall outlet 603. Informer 604 includes a sensor circuit (not expressly shown) operable to determine when power is being consumed by home appliance 606 and may output status information to remote status notification device 607.

During operation, informer 604 senses when home appliance 606 is consuming power and monitors if home appliance 606 to determine if home appliance is "ON" or "OFF". Informer 604 determines an operating state of home appliance 606 and transmits a signal including the current operating status to remote status notification device 607. For example, remote status notification device 607 may include a power indicator, an alarm indicator, an output speaker, and an acknowledge button similar to keyfob 503 of FIG. 5. When a user having remote status notification device 607 is out of range of informer 604, remote status notification device 607 determines a last state communicated by informer 604 and if home appliance 606 was left in an "ON" position, remote status notification device 607 provides a warning (e.g., visual and/or audible warning and/or vibration) indicating that a home appliance was left "ON". In this manner, informer 604 may be placed in series with home appliance 606 and an operating state communicated to remote status notification device 607 thereby allowing a user to return to a home premises and alter an operating state of a home appliance 606 as needed.

Figure 7:
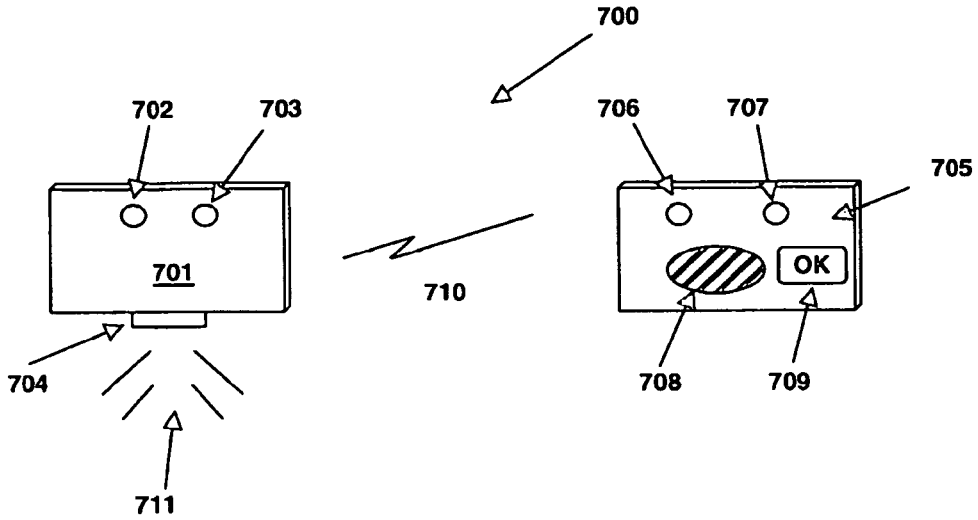
FIG. 7 illustrates an informer employing an ultrasonic sensor for use with a garage door and a remote status notification device according to one aspect of the invention.

FIG. 7 illustrates an informer employing an ultrasonic sensor for use with a garage door and a remote status notification device according to one aspect of the invention. An informer 701 includes, a power light 702 operable to be illuminated when power is applied to informer 701, an ultrasonic sensor 704 and an sensor indicator 703 operable to be illuminated if a garage door (not expressly shown) is closed or open. Various types of sensors may be used instead of ultrasonic sensor 704 including but not limited to, a laser distance sensor or infrared sensor.

Informer 701 further includes an RF communication module operable to communicate a status message via an RF communication medium 710 based on a current operating state of ultrasonic sensor 704 to a remote status notification device 705. For example, informer 701 may be positioned along a bottom of a garage door and may sense an operating state of a garage door (i.e. open, closed, opening, closing, etc.) and transmit a signal via RF communication medium 710 indicating a current operating state sensed by ultrasonic sensor 704. Ultrasonic sensor 704 may also be used to monitor an operating state of various types of environmental elements such as an operating state of a garage door, doors for a buildings or residences, etc.

Remote status notification device 705 includes a power light 706 indicating when power is on and functioning, a status notification light 707 indicating an operating state provided by informer 701, and an output speaker 708 operable to output an audible tone that may output beeping sounds or a recorded warning message. Remote status notification device 705 further includes an acknowledge button 709 that may be activated to acknowledge a status being output. In one embodiment, remote status notification device 705 may be integrated as a part of a remote garage door opener device.

During use, informer 701 transmits a status signal indicating a current operating state of a garage door. For instance, informer 701 may communicate an "open" status or "closed" status and remote status notification device 705 stores the current message within memory (not expressly shown). Remote status notification device 705 continues to receive signals communicated by informer 701 at a regular interval and store a current state within memory of remote status notification device 705. When a driver drives away from informer 701 or when remote status notification device 705 is no longer within range of RF communication medium 710, remote status notification device 705 does not receive a signal communicated by informer 701 and retrieves the last current operating state from memory and determines if the last received operating state is an adverse state. If the last operating state is an adverse operating state, remote status notification device illuminates status light 707 and/or outputs an audible warning using speaker 708. A user may then press acknowledge or 'OK' button 709 to reset the output. In one embodiment, if a user ignores an output, remote status notification device 705 may terminate the output after a predetermined period of time has elapsed. In another embodiment, an output or alarm may automatically turn off as a driver returns to a premises or towards informer 701 and remote status notification device 705 is within range to receive a signal communicated by informer 701.

Figure 8:
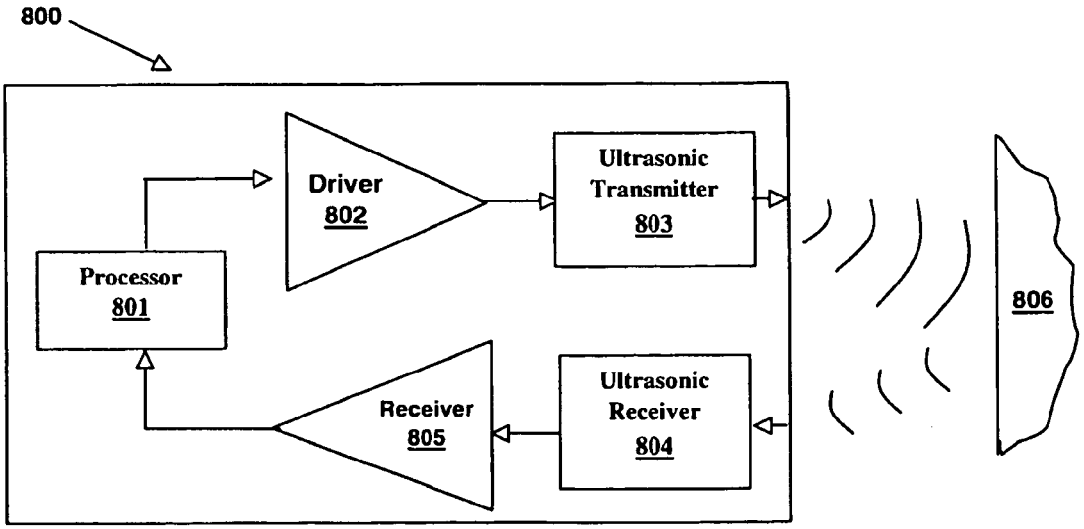
FIG. 8 illustrates a functional block diagram of ultrasonic sensor module operable to be provided in association with a wireless enabled notification system according to one aspect of the invention.

FIG. 8 illustrates a functional block diagram of ultrasonic sensor module operable to be provided in association with a wireless enabled notification system according to one aspect of the invention. Ultrasonic sensor module, illustrated generally at 800 includes a processor 801 a driver circuit 802 coupled to an ultrasonic transmitter 803 operable to output an ultrasonic signal to sense an object 806 such as a wall, floor, etc. Ultrasonic sensor module 800 further includes an ultrasonic receiver 804 and receiver amplifier 805 is operable to sense ultrasonic signals output by ultrasonic transmitter 803 and reflected of object 806.

During operation, processor 801 provides a short duration pulse to driver circuit 802 and drive circuit 802 generates a short duration output pulse signal having a frequency of approximately forty (40) KHz and ultrasonic transmitter 803 outputs a forty (40) KHz signal. When the output signal in incident on object 806, an output signal is reflected and returned to ultrasonic sensor module 800 and detected by ultrasonic receiver 804. The received signals are amplified by receiver amplifier 805 and provided to processor 801 to determine a distance. For example, processor 801 determines a distance between ultrasonic sensor module 800 and an object by measuring the amount of time elapsed between a transmitting and receiving of a forty (40) KHz output signal. For example, the output signal may be provided at a fixed interval and processor 801 measures the amount of time it takes to receive a return signal using ultrasonic receiver 804. Through measuring the time it takes for a signal to travel, processor 801 is capable of determining the distance ultrasonic sensor is from object 806. For example, if ultrasonic sensor module 800 is provided in association with a garage door, ultrasonic sensor module 800 can sense if a garage door is "opening," "closing," "opened," and "closed" based on a varying or fixed time it takes for a signal to return. For example, processor 801 may determine that a garage door is closed if the amount of time to receive a signal is not changing and is returned in a relatively short interval. If a garage door is placed in an open position, processor 801 would sense that the garage door is not moving but the interval of time to receive a return signal may be long or longer than when in a closed state. Similarly, if the amount of time for a signal to returned is increasing, processor 801 would sense that a door is opening and if the mount of time is decreasing, processor 801 would determine that a door is closing.

Figure 9:
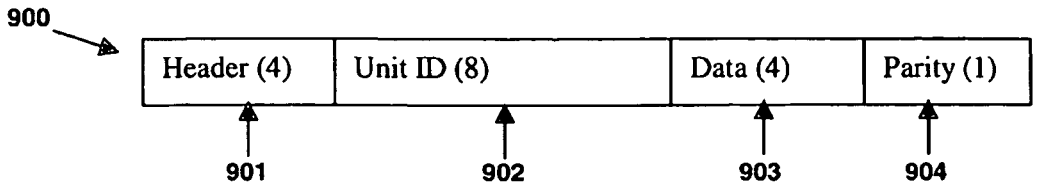
FIG. 9 illustrates an data packet format for use with a wireless enabled notification system according to one aspect of the invention.

FIG. 9 illustrates a data packet format for use with a wireless enabled notification system according to one aspect of the invention. A data packet 900 illustrates one format of a protocol that may be used by various systems disclosed herein. Data packet 900 includes a header field that is four (4) bits in length, a unit identifier field 902 that is eight (8) bits in length, a data field 903 that is four (4) bits in length, and a parity field 904 that includes one (1) bit. Various other field lengths and overall sizes for data packet 900 may also be employed. For example, a parity bit field 904 is employed within data packet 900 however other verification methods may be used including CRC (Cyclic Redundancy Checks) to insure that communication error may be detected or corrected. In another embodiment, data packet 900 may include one or more trailer bit(s) before the parity bit to indicate the end of the packet. Various other error checking may be employed as needed.

Data packet 900 may take on several forms or formats and should include, at a minimum, unit identifier field 902 and data field 903. As illustrated, data packet 900 includes a header field 901 having any four (4) bit combination of values. A value provided within unit identifier field 902 may include a unique identification that is established between an informer and a remote status notification device. A value provided in unit ID field 902 may originate from a dipswitch associated with an informer and programmed into memory of a remote status notification device. In another embodiment, a non-volatile memory may include a unique ID that may be provided as Unit ID 902 and may be programmed into memory of a remote status notification device. Other forms of providing a value for Unit ID 902 may also be employed to establish a relationship between an informer and a remote status notification device such that when a remote status notification device receives data packet 900, a remote status notification device may determine a unique identification number provided within Unit ID field 902 used to establish a relationship between an informer and a remote status notification device. For example, if an informer having a different unit identifier communicates a data packet and a remote status notification device receives the data packet having an identifier for an unassociated informer, the remote status notification device would ignore the data packet even if the format is the same format as data packet 900.

Data field 903 of data packet 900 may include the following values when data packet 900 is provided in association with a garage door:

0101: Door closed

1010: Door open

For example, when data packet 900 is employed within a notification system provided in association with determining an operating state of a garage door, an informer formats data packet 900 to include a status message within data field 903 indicating an operating status of a garage door. An informer further includes formatting header data provided within header field 901 and a unique identification number provided within Unit ID field 902 and used to establish between an informer and a remote status notification device. An informer further includes a parity bit within parity bit field 904 and communicates data packet 900 using an RF communication medium. When a remote status notification device receives data packet 900, it reads the data within unit identification field 902 and, if valid, determines the value provided within data field 903 and stores the value within memory for subsequent use as needed. In this manner, a separate frequencies or band of frequencies may not be required to uniquely identify or establish a relationship between an informer and a remote status notification device.

Figure 10:
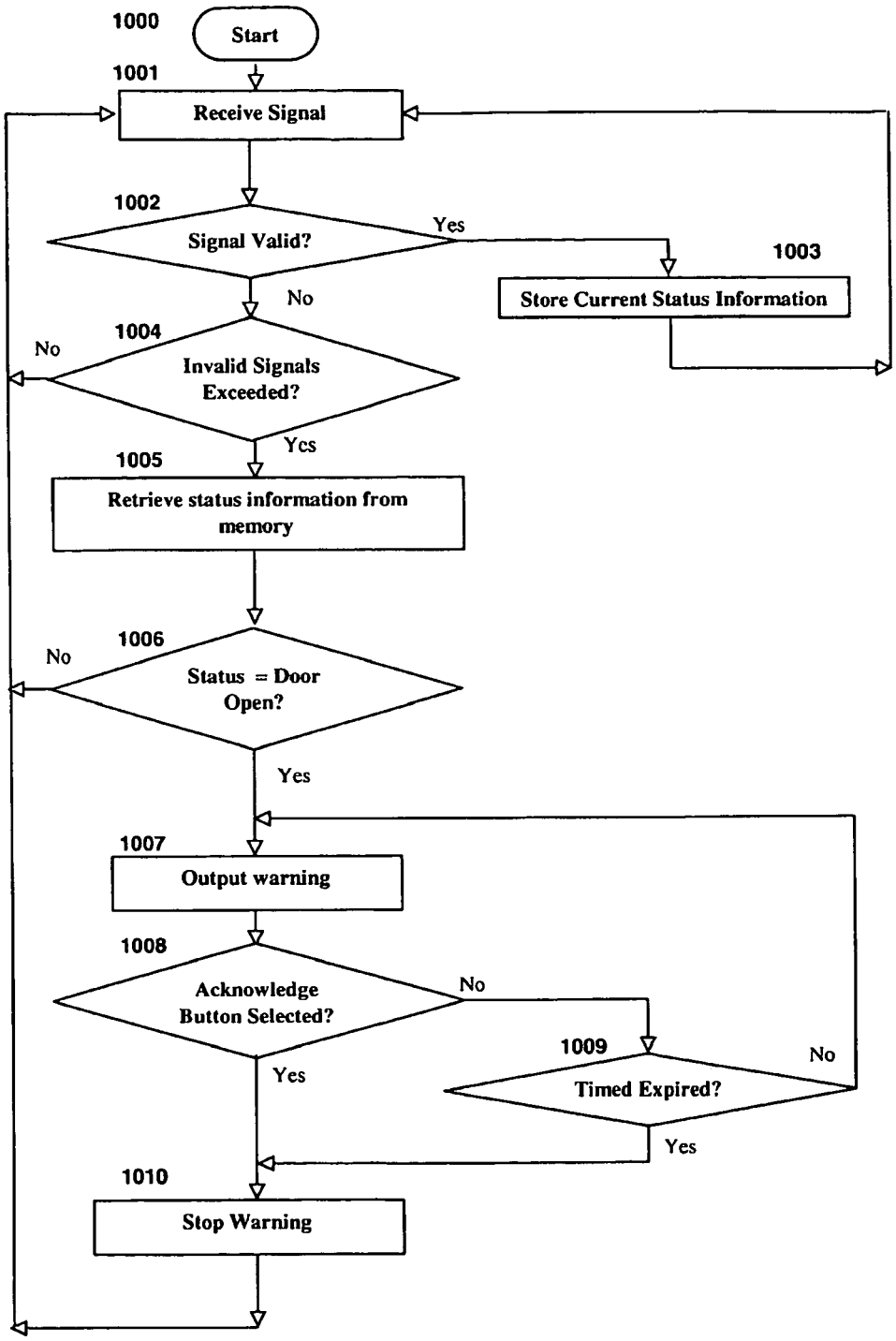
FIG. 10 illustrates a flow diagram of a method of providing a notification of an operating status of a garage door via a wireless notification system according to one aspect of the invention.

FIG. 10 illustrates a flow diagram of a method of providing a notification of an operating status of a garage door via a wireless notification system according to one aspect of the invention. The method may be employed by notification system 300 illustrated in FIG. 3 and may employ a message format of data packet 900 illustrated in FIG. 9. The method begins generally at step 1000. At step 1001, when a signal is received by a remote status notification device such as remote status notification device 307 illustrated in FIG. 3. A message or data packet communicated by informer 304 is received at step 1002 and analyzed to determine if the received signal is valid. For example, a signal is analyzed to verify a data format including determining if a valid unit identification number and status information are provided within the data packet. If a signal is valid, the current status information provided within the data packet is stored 1003 within a memory device of a remote status notification device and the method proceed to step 1001. If an invalid signal is received, the signal is analyzed to determine if remote control status notification device is out of range 1004. For example, if a weak signal is received at 1001, or only a portion of a data packet is received, a data packet may not include valid or verifiable information indicating that remote status notification device may be out of range. If a signal is not out of range and is invalid, the signal is ignored and the method proceeds to step 1001 to receive a signal. For example, if a signal includes a unit ID that is not associated with the remote status notification device, a valid unit ID, the signal would be ignored and the method would proceed to step 1001.

In one embodiment, the method may determine the number of invalid or weak signals received. For example, the method may continue to receive signals until five (5) invalid or weak signals in a row are received or missed. When the number of invalid or weak signals is exceeded, the method proceeds to step 1005 and retrieve status or state information from a memory device of the remote status notification device. If the last status or state indicates that a garage door has not been left open, the method proceeds to monitor for signals at step 1001. If a status indicates that a garage door has been left open, an output warning is provided 1007 and a user may select an acknowledge button to silence the warning at 1008. If a user silences a warning by selecting an acknowledge button at 1008, the warning is stopped at 1010 and the method continues at 1001. If a user does not select an acknowledge button and a time period for outputting a warning expires at 1009, the output warning is terminated at 1010 and the method continues at 1001.

Figure 11:
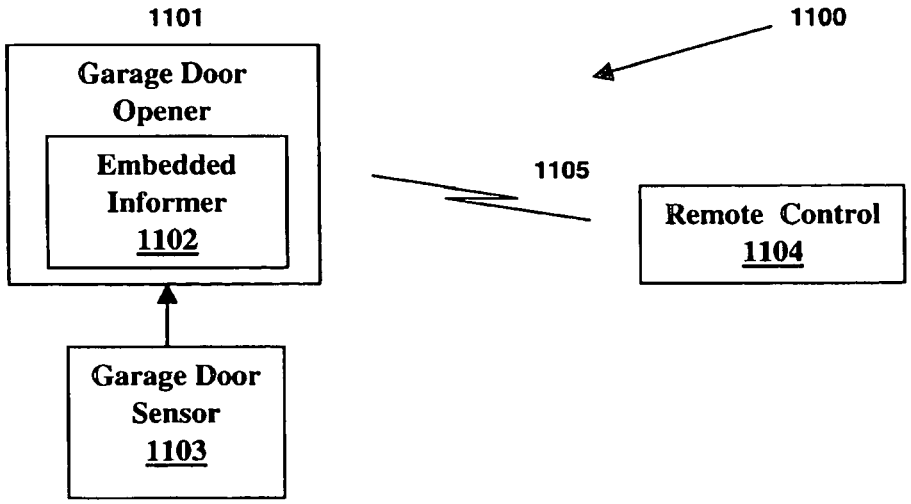
FIG. 11 illustrates a wireless notification system integrated within an automatic garage door opener system according to one aspect of the invention.

FIG. 11 illustrates a wireless notification system integrated within an automatic garage door opener system according to one aspect of the invention. An automatic garage door opener system, illustrated generally at 1100 includes an embedded informer 1102 provided as a part of a garage door opener including a remote control 1104 for automatically opening and closing a garage door and a garage door sensor 1103 that determines a current operating state of a garage door and provides a current operating state to embedded informer 1102. Garage door sensor 1103 is provided as a separate unit from the garage door opener 1101 however garage door sensor 1103 may be an integral part of garage door opener 1101 and/or embedded informer 1102 as needed. Automatic garage door system 1100 further includes a remote control operable to provide commands for activating garage door opener 1101 to open or close a garage door as needed. Remote control 1104 also includes logic and functionality similar to remote status notification device 103 illustrated in FIG. 1 and operable to output a status notification of an operating state of a garage door opener 1101. Remote control 1104 further provides functionality for controlling an operating mode of garage door opener 1101 and allows a user to both receive a status notification message and provide signals from remote control 1104 to alter an operating state of a garage door opener 1101. In this manner, if an adverse operating condition is communicated from embedded informer 1102 to remote control 1104 (i.e. a garage door is left open), a user may activate a control button associated with remote control 1104 and alter the adverse condition as desired. In this manner, remote control 1104 may both receive and output an operating state of garage door opener 1101 to a user and allow a user to remotely alter an operating status of garage door opener 1101 obviating the need to provide a second electronic device for altering an operating status.

In one embodiment, a remote control 1104 including an embedded status notification device may utilize a movement sensor (not expressly shown) such as vibration sensor to turn on and receive messages communicated by embedded informer 1102 thereby conserving energy of remote control 1104. For example, when an automobile is parked or not moving, embedded informer 1102 may not communicate a signal and remote control 1104 may not receive signals. When remote control 1104 detects vibration when an automobile begins to move, remote control 1104 sends a query to embedded informer 1102 located within garage door opener 1101. Embedded informer 1102 and/or garage door sensor 1103 may awaken if previously placed in a sleep state or other energy conserving state, and receive a current operating state from garage door sensor 1103. Embedded informer 1102 then formats and sends a responding message based on the query from remote control 1104. Remote control 1104 receives the message and stores the state information within memory or remote control 1104. If remote control 1104 does not receive any additional messages or replies from embedded informer 1102 for a pre-determined duration of time (e.g. five (5) seconds), remote control 1104 determines that embedded informer 1102 and remote control 1104 are out of range from each other and a warning may be produced if an adverse operating state is retrieved from memory of remote control 1104. Upon remote control 1104 taking an appropriate action based on a current operating state (e.g., producing a warning or not producing a warning), remote control 1104 may return to an inactive state or sleep state until detecting a valid signal from embedded informer 1102. In one embodiment, embedded informer 1102 and/or garage door sensor 1103 may return to a sleep state or reduced operating state until sensing when remote control 1104 is within range of embedded informer 1102.

Figure 12:
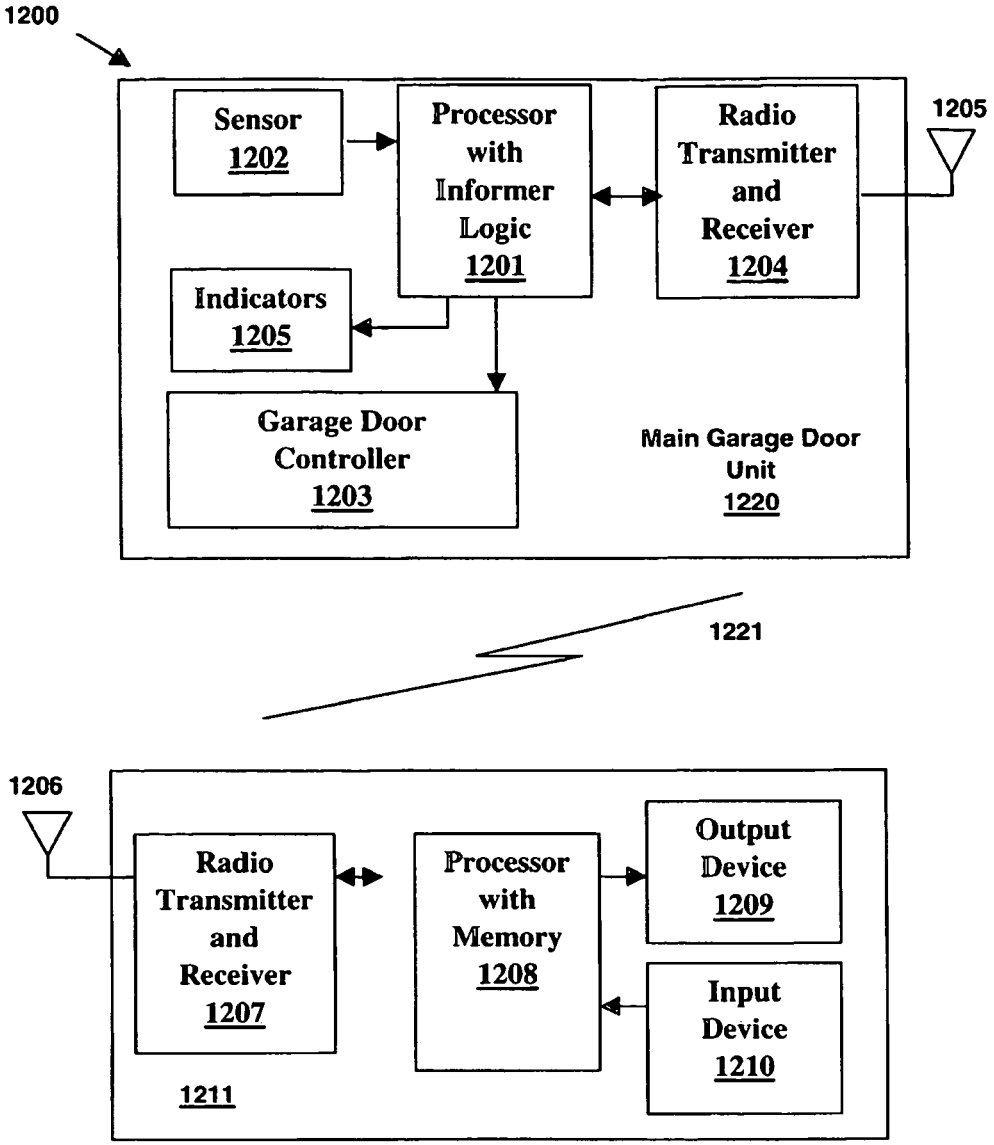
FIG. 12 illustrates a functional block diagram of a wireless notification system integrated within an automatic garage door opener system according to one aspect of the invention.

FIG. 12 illustrates a functional block diagram of a wireless notification system integrated within an automatic garage door opener system according to one aspect of the invention. An automatic garage door opener system, illustrated generally at 1200, includes main garage door unit 1220 having a processor and informer logic 1201, a garage door controller 1203 for physically opening and closing a garage door, a sensor 1202 for sensing an operating state of a garage door and indicators 1205 for indicating a power status or operating state of automatic garage door opener 1200 when in use. Informer logic may be provided as an integral part of processor 1201 located within memory of processor 1201 or may be provided as a separate device such as a controller having internal logic, a ROM device, an EEPROM device, a Flash memory device, digitally programmed logic, or any other type of electronic device operable to provide an informer for detecting an operating state provided by a sensor. Sensor 1202 may also be provided as a part of garage door controller 1203 to sense an operating state of a garage door by detecting operation of garage door controller 1203 to determine if a door is open, closed, or if there is an obstruction in the way of a door when a door is in use to stop the door if an obstruction is detected. Various other types of statuses or operating states may also be sensed by sensor 1202 when provided as a part of garage door controller 1203. Sensor 1202 may be implemented in various other ways. For example, sensor 1202 may be placed remote from main garage door unit 1220 on a wall near a garage door and to detect an operating state of a garage door using various types of sensors. Additionally, main garage door unit 1220 includes internal logic for controlling garage door controller 1203 and allows for altering an operating state of a garage door. For example, processor 1201 sends commands to garage door controlling 1202 to control a motor and associated mechanical linkage to open or close a garage door.

Main garage door unit 1220 further includes a radio transmitter and receiver 1204 operable to communicate radio frequency (RF) signals having a status message or data packet similar to data packet 900 illustrated in FIG. 9 via RF communication medium 1221. A message or data packet communicated by radio transmitter and receiver 1204 includes a unique identification number identifying main garage door unit 1220 and an operating state or status of a garage door provided by sensor 1202 and determined by processor and informer logic 1201.

Automatic garage door system 1200 further includes a remote control 1211 operable to receive and transmit signals using RF communication medium 1221. Remote control 1211 operates as both a remote status notification device such as remote status notification device 705 of FIG. 7 and a remote garage door controller for remotely controlling automatic garage door unit 1220 to open and close a garage door. Remote control 1211 includes an antenna and radio transmitter and receiver 1207 for receiving and communicating data packets or messages via RF communication medium 1221. Remote control 1211 further includes a processor 1208 having memory and an output device 1209 such as a speaker or indicator operable to provide a warning to a user. Remote control 1211 further includes an input device 1210 having at least one button operable to provide a command to open/close a garage door similar to a conventional garage door opener. Input device 1210 further includes an acknowledge button to acknowledge an operating status of main garage door unite 1220 and output by output device 1209. In one form, a single button may be provided for input device 1210 and operable as an acknowledge button and an open/close door remote control button.

During operation, main garage door unit 1220 determines the status of the garage door using sensors 1202 and processes the sensed position of the door using processor having informer logic 1201 and formats a message to be communicated by transmitter and receiver 1204. The status message includes a reference to identify main garage door unit 1220 and a message including a current operating state sensed by sensors 1202. Main garage door unit 1220 transmits the formatted door status information via RF communication medium 1221 and remote control 1221 detects the transmission using antenna 1206. In one embodiment, remote control 1211 may output current status information using output device 1209 or may store a current status within memory of processor 1208. If remote control 1211 stores a current state within memory of processor 1208, remote control 1211 monitors for signals sent by main garage door unit 1220 and when remote control 1211 is out of range of main garage door unit 1220, processor 1208 accesses memory of processor 1208 to determine a last current state for main garage door unit 1220. If an adverse condition exists, output device 1209 is activated to warn a user that an adverse operating condition of a garage exists. A user may then activate input device 1210 to silence or acknowledge the output. If an adverse condition does not exist, remote control 1211 may not output a signal using output device 1209. In one form, if a desired output condition exists, output device 1209 may provide an output to indicate a desired operating condition.

In one embodiment, garage door controller 1203 may include a separate sensor in addition to, or instead of sensor 1202. For example, garage door controller 1203 controls a mechanical linkage such as chains or other means for displacing a garage door, garage door controller 1203 may sense when a door is opened, opening, closed or closing without having sensor 1202. In this manner, garage door controller 1203 may provide an input to processor 1201 for determining an operating state of main garage door unit 1220 and communicate to remote control 1211.

In one embodiment, remote control 1211 includes a vibration sensor operable to detect when remote control 1211 is moving. For example, when remote control 1211 is provided within a vehicle and a user drives a vehicle, a vibration sensor within remote control 1211 senses movement and sends a query via radio transmitter and receiver 1207 to determine an operating state of a garage door. Main garage door unit 1220 receives the inquiry and processor 1201 determines an operating state in response to the inquiry. In this manner, sensor 1202 may only make inquiries into current operating states of a garage door based on a movement sensed by remote control 1211 thereby reducing power consumption of sensor 1202.

Figure 13A:
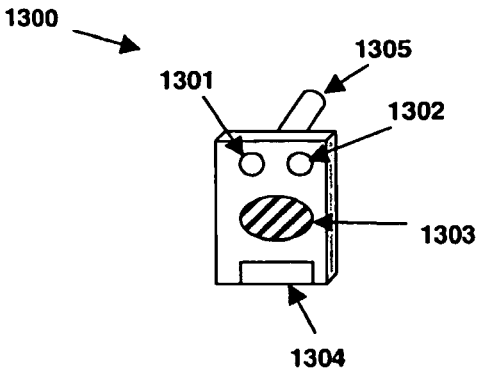
FIG. 13A illustrates a remote status notification device employing a universal twelve-volt power adapter for use with a wireless enabled notification system according to one aspect of the invention.

FIG. 13A illustrates a remote status notification device employing a universal twelve-volt power adapter according to one aspect of the invention. A remote status notification device 1300 includes a power indicator 1301, a status indicator 1302, a speaker 1303, a universal twelve-volt plug 1305, and a control button 1304. Remote status notification device 1300 having universal twelve-volt charge plug 1305 allows for remote status notification device 1300 to be plugged into a vehicles twelve-volt charge port (not expressly shown). For example, remote status notification device 1300 may obtain power using a universal twelve-volt plug operable to interface a vehicle's twelve-volt charge port to power, charge, or recharge remote status notification device 1300 as needed.

Figure 13B:
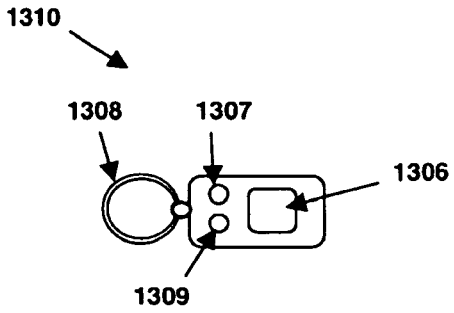
FIG. 13B illustrates an remote status notification device provided as a key-fob for use with a radio frequency enabled communication notification system according to one aspect of the invention.

FIG. 13B illustrates a remote notification device provided as a key-fob for use with a wireless enabled notification system according to one aspect of the invention. A remote status notification device, illustrated as key-fob 1310, includes a power indicator 1307, a status indicator 1309, and an input device 1306. Key-fob 1310 further includes a key chain for holding various types of keys. Key-fob 1310 includes an internal battery and is sized to allow a user to place key-fob 1310 and any associated keys within a pocket, purse bag, etc. Key-fob 1310 further includes a vibrator element (not expressly shown) housed within key-fob 1310 and operable to output a vibration when an adverse operating condition is detected and output by key-fob 1310.

According to one aspect, key-fob 1310 may be operable as a remote control for locking and unlocking a car door, setting a car alarm, etc. Additionally, an automobile may include an informer operable to communicate an operating state of a vehicle to a key-fob 1310 to alert a user of an adverse operating condition. For example, if a user leaves a door of a vehicle unlocked or if a door is a jar, a vehicle may detect the open or unlocked door and communicate the adverse condition to keyfob 1301. Key-fob 1310 may illuminate status indicator 1309 or activate a vibration element to alert a user of the adverse condition. A user may then press button 1306 to acknowledge the condition. In one form, button 1306 may provide a dual purpose of locking a vehicle's door in addition to acknowledging that an adverse condition exists. In one form, if selecting button 1306 does not lock the vehicle and the indicator does not extinguish, a user may return to the vehicle to determine if a door was left open.

Figure 14:
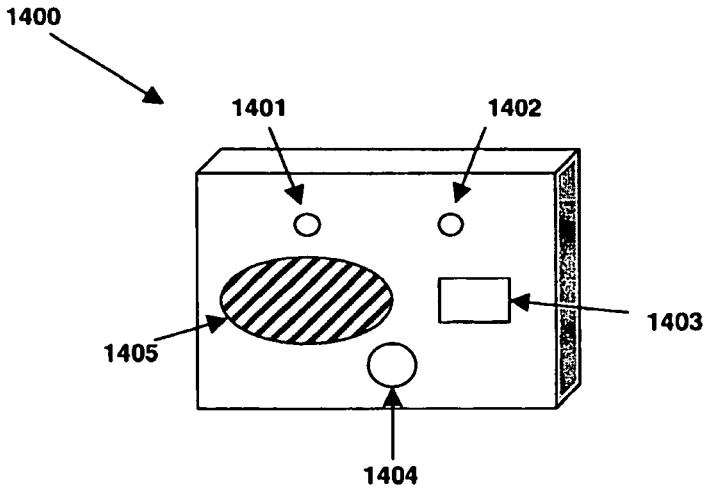
FIG. 14 illustrates a motion sensor enabled remote status notification device for use with a wireless enabled notification system according to one aspect of the invention.

FIG. 14 illustrates a motion sensor enabled remote status notification device for use with a wireless enabled notification system according to one aspect of the invention. A remote status notification device, illustrated as motion activated notification device 1400, includes a power indicator 1401, a status indicator 1402, a speaker 1405 and an acknowledge button 1403. Motion activated notification device 1400 further includes a motion sensor 1404 for detecting motion proximal to motion activated notification device 1400.

During operation, motion activated notification device 1400 may be placed at various locations within a house such as in a bedroom, bathroom, kitchen, utility room, etc. As an occupant or user approaches motion activated notification device 1400, motion sensor 1404 senses proximal movement and outputs an adverse operating condition for an environmental element if an adverse condition exists. For example, when a user enters a bedroom or bathroom to retire for an evening, motion sensor 1404 when placed in a bedroom or bathroom may sense a user and provide an output if an adverse operating state for an environmental element exists. For example, if a user forgot to close a garage door, motion activated notification device 1400 would output a warning to a user alerting them of the adverse condition. A warning may providing an audible warning describing the adverse condition may be output such as 'Garage Door Open', 'Front Door Unlocked', 'Oven On', etc. Other outputs may also be provided such as a visual warning or blinking light provided by illuminator 1402 and a user may silence an alarm or warning through pressing acknowledge button 1403.

In one embodiment, motion activated notification device 1400 may be connected to a home network using a wireless communication, Ethernet connection, twisted-pair connection, or various other types of connections. In one form, motion activated notification device 1400 may be integrated as a part of a home security network and provide status information for various environmental elements for a home detected by a security system.

Figure 15:
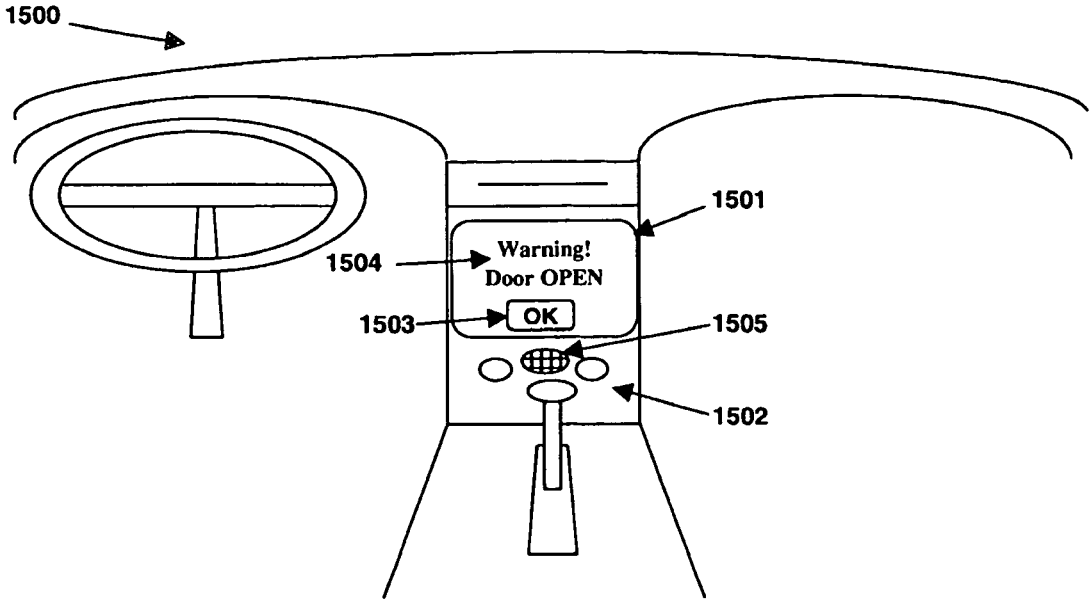
FIG. 15 illustrates a vehicle console incorporating a remote status notification device according to one aspect of the invention.

FIG. 15 illustrates a vehicle console incorporating a remote status notification system according to one aspect of the invention. A portion of an interior of a vehicle, illustrated generally at 1500, includes a center console 1502 including a touchscreen display 1501 operable to display a status output 1504 of an operating condition for one or more environmental elements. Other types of displays may also be employed. Touchscreen display 1501 further includes an acknowledge button illustrated as an 'OK' button 1503 that may be activated to acknowledge a warning. Center console 1502 further includes a speaker 1505 provided in association with a vehicle's sound system (not expressly shown) and operable to output an audible tone or message indicating an adverse condition exists. Center console 1502 may also be operable as a control system for controlling various elements or systems within a vehicle including, but not limited to, a satellite radio or conventional radio or media system, environmental controls such as temperature, defrost, fan, etc. In one form, center console 1502 may be operable to a display navigation system for a user. Center console 1502 further includes embedded logic that may be provided in association or independent of a vehicle control system. For example, a remote status notification device, such as remote status notification device 1211 illustrated in FIG. 12 may be modified to interface to provide signals to a vehicle's control system to output warnings using touchscreen display 1501. For example, a graphical user interface displayed within touchscreen display 1501 may include one or more subsystems for querying status and control information within a vehicle. A status message may be communicated by an informer and received by a remote status notification device provided in association with the vehicle's control system. The status message is processed by the remote status notification device provided in association with a vehicle's control system to determine if an adverse condition exists. If an adverse condition is determined, a message is displayed within touchscreen display 1501 to a vehicle operator alerting the vehicles operator of the adverse condition. In this manner, through integrating a remote status notification device as a part of a vehicle's control system, a separate device is not needed for providing status information to an operator of a vehicle.

Figure 16:
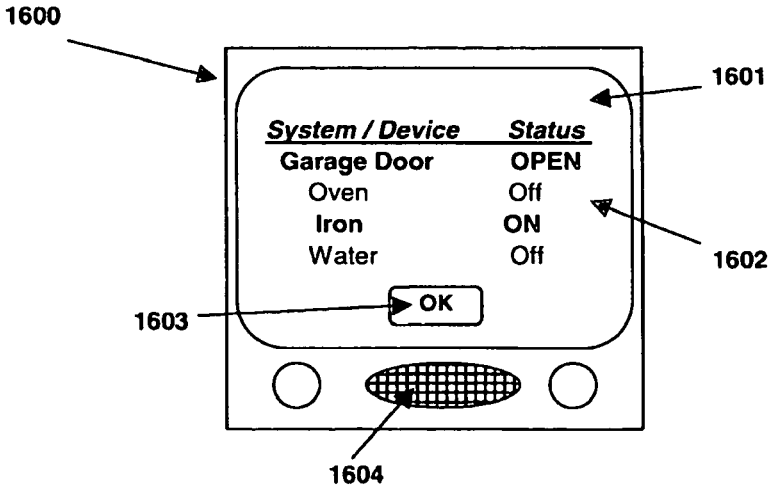
FIG. 16 illustrates a vehicle's graphical user interface operable to display plural operating statuses for plural environmental elements associated with a wireless enabled notification system according to one aspect of the invention.

FIG. 16 illustrates a vehicle's graphical user interface operable to display plural operating statuses for environmental elements associated with a wireless enabled notification system according to one aspect of the invention. A vehicle console 1600 includes a graphical user interface 1601 operable to display several operating conditions 1602 for plural environmental elements detected by an informer and communicated to a remote status notification device provided in association with a vehicle. For example, graphical user interface 1601 may display a status for a garage door, an oven, an iron, water, etc. Various other types of environmental elements may also be detected and displayed.

During use, graphical user interface 1601 displays a series of elements and their current operating conditions or statuses communicated by an associated informer. For example, a separate informer may be provided in association with each environmental element of a residence and communicate a status message to a remote status notification device operably associated with a vehicle's control system. Graphical user interface 1601 presents a current operating state for several environmental elements of a residence as a user leaves a residence so that a user may return to a home or residence to alter an operating condition if an adverse condition is detected.

For example, if an adverse condition exists, an audio output may also be provided via speaker 1604 alerting a user to the condition and a user may acknowledge an adverse condition by selecting 'OK' button 1603 displayed within graphical user interface 1601. In this manner, a user may be provided a summary of operating conditions for a series of environmental elements of a residence.

In one form, a vehicle's control system (not expressly shown) may include one or more sensor's for detecting an operating status of one or more portions of a vehicle. A vehicle's control system may further include an informer such as informer 102 of FIG. 1 operable to detect an operating status and communicate an operating status to a remote car alarm controller including logic for providing a remote status notification device. For example, keyfob 1305 of FIG. 13 may be used. If a vehicle's control system detects an adverse operating condition, an informer associated with the vehicle communicates a message to keyfob 1305 alerting a user to the adverse condition. For example, if a user forgets to lock a vehicle, a door was left a jar or open, a window left open, lights were left on, etc., a vehicle's informer communicates the adverse condition to keyfob 1305 and a user may correct the operating condition as needed.

Figure 17A:
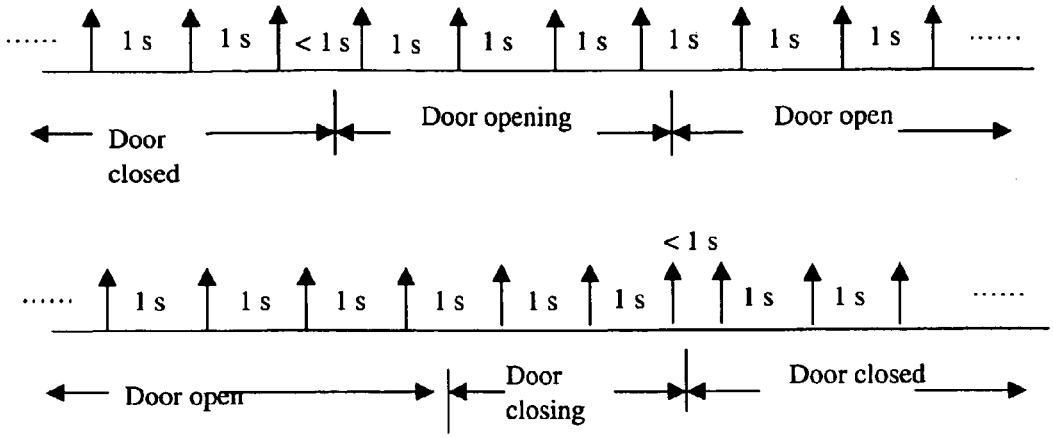
FIGS. 17A and 17B illustrate timing diagrams for outputting sensor signals using an automatic garage door system employing a wireless notification system according to one aspect of the invention.
Figure 17B:
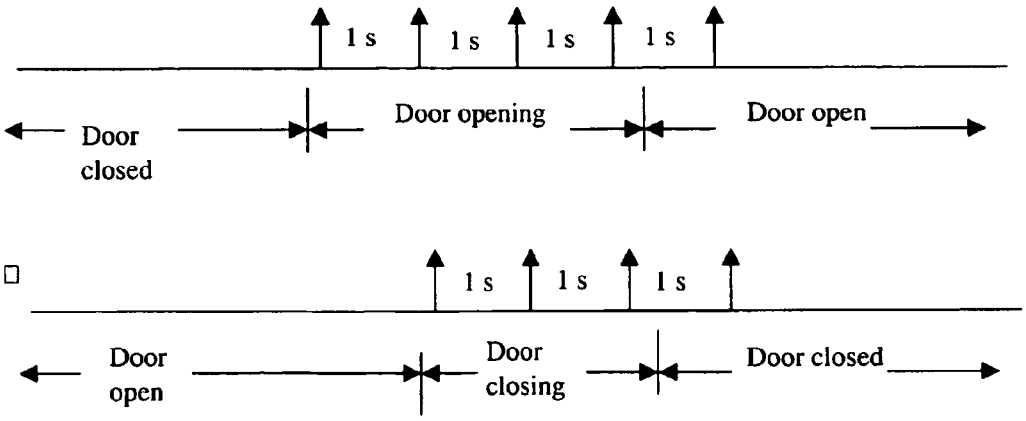

FIGS. 17A and 17B illustrate timing diagrams for outputting sensor signals using an automatic garage door system employing a wireless notification system according to one aspect of the invention. The timing sequences of FIGS. 17A and 17B may be employed by system 1200 illustrated in FIG. 12 or any other system operable to employ the timing sequences provided in FIGS. 17A and 17B.

A sensor, such as ultrasonic sensor 701 illustrated in FIG. 7 measures distance at a regular interval (e.g., 1 sec). Ultrasonic sensor 701 may be battery operated and when activated to measure distances, ultrasonic sensor 701 includes a vibration sensor to activate sending a signal and measures the distance to the floor only when a door is moving (i.e., vibration is detected). For example, instead of continuously measuring a distance using ultrasonic sensor 701, distances are only measure when ultrasonic sensor 701 is moving. Additionally, ultrasonic sensor 701 may include a register that holds a current state and sends state information an informer. Informer 700 then transmits state information at a pre-determined transmission interval.

In one form, a sensor being used in association with a garage door may detect four different states but only register or communicate two states. For example, a sensor may detect:

1) Open State:
a. Door Opened
b. Door Opening
2) Close State:
a. Door Closed
b. Door Closing As illustrated above, a "door open" state and "door opening" state are considered the same state or an "open" state. Similarly, a "door closed" state and "door closing" state are considered a "closed" state. An adverse operating condition would include a "door open" state or "door opening" state and a desired operating condition would include a "door closed" state or "door closing" state.

FIG. 17B illustrates a timing diagram when a sensor updates during times when a garage door is moving to conserve energy. For example, a sensor updates or send an operating state of a door at regular interval while it is moving or in a "door opening" condition. When a sensor senses that a door stops moving, a signal is sent indicating the current operating state and stops sensing while a door has stopped moving. For example, ultrasonic sensor 701 may detect if a door is closing or opening at period of one (1) second based on a vibration sensor sensing when a door is moving. When a vibration sensor does not detect any movement, ultrasonic sensor 701 senses a current state for one more period when a door is not moving provides as a last state. When vibration sensor detects a door is moving, ultrasonic sensor energizes to detect a new state and communicates the state until movement stops. In this manner, energy such as batteries of an ultrasonic sensor are conserved when a door is static or not moving (e.g. closed or open).

Note that although an embodiment of the invention has been shown and described in detail herein, along with certain variants thereof, many other varied embodiments that incorporate the teachings of the invention may be easily constructed by those skilled in the art. Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. Accordingly, the invention is not intended to be limited to the specific form set forth herein, but on the contrary, it is intended to cover such alternatives, modifications, and equivalents, as can be reasonably included within the spirit and scope of the invention.

What is claimed is:

1. A remote status notification device, comprising:

a receiver configured to receive a plurality of status messages for a plurality of environmental elements;

a processor configured to determine a current operating condition for the environmental element based on the plurality of status messages, wherein the current operating condition comprises a determination of an adverse condition or a favorable condition for the environmental element; and a display configured to display a summary of the current operating conditions for the plurality of environmental elements, wherein the summary indicates, for each environmental element, that the current operating condition for the environmental element comprises the adverse condition or the favorable condition.

2. The remote status notification device of claim 1, wherein the plurality of environmental elements comprise an operating status of a vehicle.

3. The remote status notification device of claim 1, wherein the plurality of environmental elements comprise an appliance associated with a residence.

4. The remote status notification device of claim 1, wherein the processor is further configured to cause indication, via the summary, of a status for each environmental element.

5. The remote status notification device of claim 1, wherein the display further comprises a graphical user interface.

6. The remote status notification device of claim 1, wherein the display comprises a touchscreen display.

7. The remote status notification device of claim 6, wherein the processor is further configured to query status and control information via the touchscreen display.

8. The remote status notification device of claim 1, further comprising a speaker.

9. The remote status notification device of claim 8, wherein the processor is further configured to provide an audio output via the speaker based on a status message of the plurality of status messages.

10. The remote status notification device of claim 8, wherein the processor is further configured to provide an audio output via the speaker responsive to determining that an adverse condition exists.

11. The remote status notification device of claim 10, wherein the adverse condition comprises at least one environment element of the plurality of environmental elements being left in an undesirable operating state.

12. A garage door opener, comprising:

a motion detector; and a processor configured to:

receive information indicating a current operating state of a garage door, detect movement using the motion detector, and responsive to detection of the movement, send a responding message comprising the current operating state.

13. The garage door opener of claim 12, further comprising a remote control.

14. The garage door opener of claim 13, wherein the remote control is configured to alter the current operating state of the garage door.

15. The garage door opener of claim 12, wherein the remote control is configured to send a status notification of the current operating state of the garage door.

16. The garage door opener of claim 12, further comprising a garage door sensor.

17. The garage door opener of claim 16, wherein receiving information indicating a current operating state of the garage door comprises receiving information from the garage door sensor about the current operating state of the garage door.

18. The garage door opener of claim 16, wherein the garage door sensor is an integral part of the garage door opener.

19. The garage door opener of claim 12, wherein the processor is further configured to:

detect that the movement has stopped using the motion detector; and in response to detecting that the movement has stopped, inhibit sending the responding message.

20. The garage door opener of claim 12, wherein the responding message comprises a last operating state of the garage door prior to a remote status notification device moving out of range of the garage door opener.

21. The garage door opener of claim 12, wherein the sending the responding message is further responsive to a determination of an adverse operating condition of the garage door.

22. A non-transitory computer-readable medium having instructions stored thereon, the instructions comprising:

instructions to receive a plurality of status messages for a plurality of environmental elements;

instructions to determine a current operating condition for the environmental element based on the plurality of status messages, wherein the current operating condition comprises a determination of an adverse condition or a favorable condition for the environmental element; and instructions to display a summary of the current operating conditions for the plurality of environmental elements, wherein the summary indicates, for each environmental element, that the current operating condition for the environmental element comprises the adverse condition or the favorable condition.

23. The non-transitory computer-readable medium of claim 22, wherein the plurality of environmental elements comprise an operating status of a vehicle.

24. The non-transitory computer-readable medium of claim 22, wherein the plurality of environmental elements comprise an appliance associated with a residence.

25. The non-transitory computer-readable medium of claim 22, further comprising instructions to indicate, via the summary, a status for each environmental element.

26. The non-transitory computer-readable medium of claim 22, further comprising instructions to query status and control information via a touchscreen display.

27. The non-transitory computer-readable medium of claim 22, further comprising instructions to provide an audio output via a speaker based on a status message of the plurality of status messages.

28. The non-transitory computer-readable medium of claim 22, further comprising instructions to provide an audio output via a speaker responsive to determining that an adverse condition exists, wherein the adverse condition comprises at least one environment element of the plurality of environmental elements being left in an undesirable operating state.

29. A method comprising:

receiving, at a receiver, a plurality of status messages for a plurality of environmental elements;

determining, at a processor, a current operating condition for the environmental element based on the plurality of status messages, wherein the current operating condition comprises a determination of an adverse condition or a favorable condition for the environmental element; and displaying, via a display module, a summary of the current operating conditions for the plurality of environmental elements, wherein the summary indicates, for each environmental element, that the current operating condition for the environmental element comprises the adverse condition or the favorable condition.

30. The method of claim 29, wherein the plurality of environmental elements comprise an operating status of a vehicle.

31. The method of claim 29, wherein the plurality of environmental elements comprise an appliance associated with a residence.

32. The method of claim 29, further comprising indicating, via the summary, a status for each environmental element.

33. The method of claim 29, further comprising querying status and control information via a touchscreen display.

34. The method of claim 29, further comprising providing an audio output via a speaker based on a status message of the plurality of status messages.

35. The method of claim 29, further comprising providing an audio output via a speaker responsive to determining that an adverse condition exists, wherein the adverse condition comprises at least one environment element of the plurality of environmental elements being left in an undesirable operating state.

* * * * *

UNITED STATES PATENT AND TRADEMARK OFFICE

CERTIFICATE OF CORRECTION

PATENT NO. : 8,653,962 B2
APPLICATION NO. : 12/395864
DATED : February 18, 2014
INVENTOR(S) : Maeng It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 736 days.

Signed and Sealed this
Second Day of June, 2015

Michelle K. Lee

Michelle K. Lee
*Director of the United States Patent and Trademark Office*